US009441490B2

(12) United States Patent
Frischbier

(10) Patent No.: US 9,441,490 B2
(45) Date of Patent: Sep. 13, 2016

(54) BLADE ROW FOR A TURBOMACHINE

(71) Applicant: MTU Aero Engines GmbH, Munich (DE)

(72) Inventor: Joerg Frischbier, Dachau (DE)

(73) Assignee: MTU Aero Engines GmbH, Munich (DE)

( * ) Notice: Subject to any disclaimer, the term of this patent is extended or adjusted under 35 U.S.C. 154(b) by 449 days.

(21) Appl. No.: 13/644,854

(22) Filed: Oct. 4, 2012

(65) Prior Publication Data

US 2013/0089424 A1 Apr. 11, 2013

(30) Foreign Application Priority Data

Oct. 7, 2011 (EP) ..... 11184254

(51) Int. Cl.

| | |
|---|---|
| ***F01D 5/22*** | (2006.01) |
| ***F01D 5/02*** | (2006.01) |
| ***F01D 5/14*** | (2006.01) |
| ***F01D 5/16*** | (2006.01) |

(52) U.S. Cl.

CPC ..... *F01D 5/225* (2013.01); *F01D 5/027* (2013.01); *F01D 5/143* (2013.01); *F01D 5/16* (2013.01); *F05D 2240/80* (2013.01); *F05D 2260/96* (2013.01)

(58) Field of Classification Search

CPC ..... F01D 5/225

USPC ..... 416/189, 190, 191, 179, 194, 195, 175, 416/203, 212 A, 212 R; 415/173.6

See application file for complete search history.

(56) References Cited

U.S. PATENT DOCUMENTS

| | | | | |
|---|---|---|---|---|
| 1,639,247 | A * | 8/1927 | Zoelly et al. | 416/190 |
| 4,097,192 | A * | 6/1978 | Kulina | 416/175 |
| 4,878,810 | A | 11/1989 | Evans | |
| 5,156,529 | A * | 10/1992 | Ferleger | F01D 5/16 29/889.2 |
| 5,511,948 | A * | 4/1996 | Suzuki et al. | 416/191 |
| 6,722,853 | B1 * | 4/2004 | Humanchuk | F01D 5/141 416/223 A |
| 7,753,652 | B2 | 7/2010 | Truckenmueller et al. | |
| 8,876,472 | B2 * | 11/2014 | Dijoud | F01D 5/141 416/2 |
| 2008/0112809 | A1 * | 5/2008 | Corral Garcia et al. | 416/189 |
| 2012/0051930 | A1 * | 3/2012 | Pandey | F01D 5/143 416/223 A |
| 2012/0099995 | A1 * | 4/2012 | Delvaux | F01D 5/30 416/203 |
| 2012/0107123 | A1 | 5/2012 | Schlemmer et al. | |

FOREIGN PATENT DOCUMENTS

| | | | |
|---|---|---|---|
| DE | 10 2009 030 566 | A1 | 12/2010 |
| GB | 252701 | A | 9/1926 |
| JP | 55023320 | A * | 2/1980 |
| JP | 2006-144575 | A | 6/2006 |

* cited by examiner

*Primary Examiner* — Richard Edgar

(74) *Attorney, Agent, or Firm* — Crowell & Moring LLP

(57) ABSTRACT

A blade row for a turbomachine, in particular a gas turbine, is disclosed. The blade row has a number of first blade arrangements each having at least one first blade and a first shroud with a first extension in the circumferential and/or axial direction and at least a number of additional blade arrangements each having at least one additional blade and one additional shroud with an additional extension in the same direction, which is different from the first extension.

12 Claims, 1 Drawing Sheet

BLADE ROW FOR A TURBOMACHINE

This application claims the priority of European Patent Document No. EP 11184254.8-1267, filed Oct. 7, 2011, the disclosure of which is expressly incorporated by reference herein.

BACKGROUND AND SUMMARY OF THE INVENTION

The present invention relates to a blade row, in particular a guide vane assembly or rotor assembly, for a turbomachine, in particular a gas turbine, and a turbomachine having at least one such blade row.

Known blade rows are composed of a plurality of blade arrangements each having one or more blades. To increase the stability of such a blade row and/or guide a working fluid, arranging shrouds on the blade tip is known, i.e., for rotor blades on the radial outside and for guide blades on the radial inside, wherein shrouds of adjacent blade arrangements contact each other in a braced manner.

Especially in the case of a loss of shroud bracing, for example after a long operating time or due to a fault, the blades may become aeroelastically unstable and flutter, which may lead to fatigue failure of the blades.

Therefore, arranging first and second blade arrangements with shrouds in an alternating manner is known from GB 252,701 B1, wherein the blades of adjacent blade arrangements have different blade profiles and the shrouds of adjacent blade arrangements have different radial wall thickness so that adjacent blade arrangements have different natural frequencies. However, in order to produce greater frequency differences in this case, the radial wall thickness would have to vary greatly. However, this would produce a greatly varying outside surface of the shroud bond in the radial direction, which can be disadvantageous dynamically and/or fluidically.

The object of the present invention is making an improved blade row available.

A blade row, according to the present invention, has a number of first blade arrangements. The number may be one or more and is even or odd in a preferred further development. The first blade arrangements each have one or more first blades and a first shroud, which, in a preferred further development, is firmly connected to the blades, in particular configured integrally with the blades. Similarly, the shroud may also be detachably connected to the blades. On the side which radially opposes the shroud, the blade(s) preferably have a blade platform, which, in a preferred further development, is firmly connected to the blades, in particular configured integrally with the blades. A blade arrangement within the scope of the present invention is therefore defined in particular by a shroud which is connected to the blade(s) of the blade arrangement.

The shrouds of the first blade arrangements each have an extension in the circumferential and axial direction; these first shrouds are preferably annular, at least substantially.

The blade row has at least a number of additional blade arrangements. This number may likewise be one or more and is even or odd in a preferred further development. Additional blade arrangements each have one or more additional blades and an additional shroud, which, in a preferred further development, is firmly connected to the blades, in particular configured integrally with the blades. Similarly, the shroud may also be detachably connected to the blades. On the side which radial opposes the shroud, the blade(s) preferably have a blade platform, which, in a preferred further development, is firmly connected to the blades, in particular configured integrally with the blades. An additional blade arrangement preferably corresponds to a first blade arrangement except for the differences explained in the following.

According to the invention, the extension of the additional shrouds is different in the circumferential and/or axial direction from the extension of the first shrouds in this direction. The additional shrouds, which are preferably likewise annular, at least substantially, may therefore be longer or shorter than the first shrouds particularly in the circumferential direction and in particular have different overhangs in the circumferential direction. In addition or as an alternative, the additional shrouds may be longer or shorter in the axial direction than the first shrouds and in particular project over or be set back from the edges of the first shrouds in the axial direction on one or both sides.

This makes it possible, preferably in the case of an at least substantially radially homogeneous outside lining of the shroud bond of the blade row, to produce different natural frequencies of the first and additional blade arrangements and thereby reduce an aerodynamic vibration, in particular in the case of the loss of a shroud bracing. In a preferred further development, the extension in the radial direction may also be different from the first shrouds and additional blade arrangements, wherein preferably, in the case of a rotor assembly, a radially unchanging or annular outer outside lining is provided and, in the case of a guide vane assembly, a radially unchanging or annular inner outside lining is provided.

In addition to an additional blade arrangement, whose additional shrouds have different extensions than the shrouds of the first blade arrangements, the blade row may have one or more numbers of other additional blade arrangements, whose other additional shrouds have an extension in the circumferential, axial and/or radial direction that is different from the corresponding extension of the other blade arrangements, in particular the first and the additional blade arrangements. Therefore, especially a number of first blade arrangements, an equal or other number of additional second blade arrangements and preferably an equal or other number of other additional third blade arrangements may be provided. In addition, an equal or other number of other additional, fourth blade arrangements may be provided, an equal or other number of other additional, fifth blade arrangements may be provided and so forth. In the process, extensions of shrouds of additional or other additional blade arrangements may be different from each other in the circumferential, axial and/or radial direction and/or from the extensions of the first shrouds. For example, the additional shrouds of additional, second blade arrangements may be shorter or longer in the circumferential direction than the first shrouds. The additional shrouds of other additional, third blade arrangements may be shorter or longer in the circumferential direction than the additional shrouds and preferably also than the first shrouds. In addition or as an alternative, the additional shrouds of additional, second blade arrangements may be wider or narrower in the axial direction than the first shrouds. The additional shrouds of other additional, third blade arrangements may be wider or narrower in the axial direction than the additional shrouds and preferably also than the first shrouds.

In a preferred embodiment, an additional extension, i.e., an extension of a shroud of an additional or one other additional blade arrangement is larger or smaller in the circumferential, axial, and/or radial directions by at least 10%, preferably by at least 15% and preferably by at least 20% than the first extension of a shroud of a first blade arrangement and/or one other additional extension of a shroud of one other additional blade arrangement. In particular, the extensions of adjacent shrouds may be disposed in opposite directions in the circumferential and axial directions, i.e., in the axial direction, wider shrouds are adjacent to narrower shrouds, which, however, are longer in the circumferential direction so that differences in mass are reduced; however, due to the different moments of inertia around the blade axes, the natural frequencies are detuned.

In a preferred embodiment, the shrouds of one or more, preferably all, blade arrangements are symmetrical to the blades of this blade arrangement in the circumferential and/or axial direction. Symmetry in the axial direction should be understood in particular to mean that the shrouds or blades project by the same amount in the axial direction on both sides, and symmetry in the circumferential direction correspondingly means that the shrouds or the blades overhang by the same amount in the circumferential direction. Similarly, the shrouds of one or more, preferably all, blade arrangements may also be asymmetrical to the blades of this blade arrangement in the circumferential and/or axial direction. In particular, shrouds may be offset from the blades of the blade arrangements in the circumferential and/or axial direction, or project or overhang on both sides of the blade arrangement by different amounts.

In a preferred embodiment, two or more, in particular all blade arrangements have the same number of blades; in a preferred further development each have precisely one blade. As explained in the foregoing, one (other) additional blade arrangement preferably corresponds, except for the extension of the shrouds, to the first blade arrangement.

In a preferred embodiment, the first and one additional, in particular all additional, blade arrangements are distributed cyclically over the circumference. If the blade row has a number of first and only a number of additional blade arrangements, they are distributed in an alternating manner over the circumference. If the blade row has a number of first blade arrangements, a number of additional, second blade arrangements, and a number of additional, third blade arrangements, in the case of a cyclical distribution, they may be distributed over the circumference, for instance in the sequence of first blade arrangement, second blade arrangement, third blade arrangement, first blade arrangement; or in the sequence of first blade arrangement, second blade arrangement, first blade arrangement, third blade arrangement, first blade arrangement.

In a preferred embodiment, shrouds of adjacent blade arrangements have complementary, in particular non-planar, contact surfaces facing each other. The contact surfaces may be configured to be undulated in particular. By designing the contact surfaces of different shrouds to be different, it is possible to ensure a predetermined distribution of the blade arrangements during assembly.

In a preferred embodiment, shrouds of at least one blade arrangement have one or more recesses or pockets, wherein shrouds of at least one other blade arrangement have no recess. In addition or as an alternative, shrouds of at least one other blade arrangement, have another number, arrangement and/or shape of recesses. Through this, the natural frequencies of the blade arrangements are also able to be detuned.

Additional features and advantages are disclosed in the subordinate claims and exemplary embodiments.

DETAILED DESCRIPTION OF THE DRAWINGS

Figure 1:
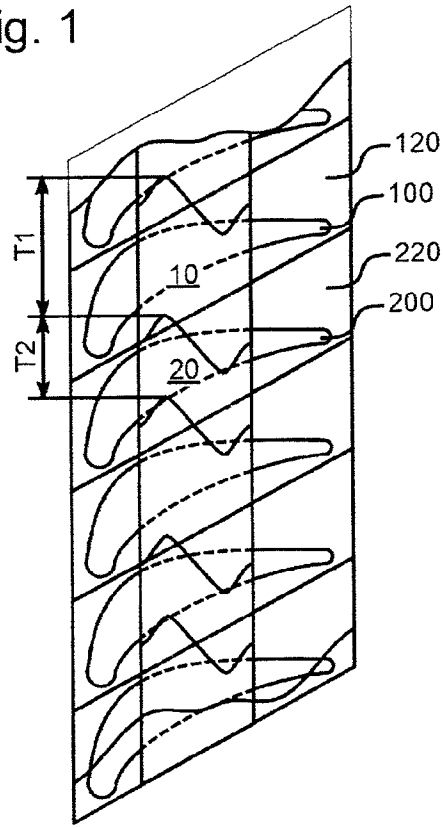
FIG. 1 shows an execution of a portion of a blade row according to an embodiment of the present invention.

FIG. 1 shows an execution of a portion of a rotor assembly of a turbine according to an embodiment of the present invention. The rotor assembly is composed in an alternating manner of first blade arrangements 120 and additional, second blade arrangements 220. Each blade arrangement has a blade platform, rotor blade 100 or 200, configured integrally therewith, and a shroud 10 or 20 configured integrally therewith. The adjacent shrouds 10, 20 have complementary, undulated contact surfaces facing each other The first shrouds 10 of the first blade arrangements 120, each having one blade 100, feature a first extension T1 in the circumferential direction (vertical in FIG. 1) and are arranged symmetrically to the blades 100 in the circumferential and axial direction (horizontal in FIG. 1), i.e., they have the same overhang or negative projection or set-back.

The second shrouds 20 of the second blade arrangements 220 are likewise arranged symmetrical to the blades 200 in the circumferential and axial direction and have a second extension T2 in the circumferential direction that is smaller than extension T1. However, in the axial and radial direction, the shrouds 10, 20 each have the same extension so that, on the one hand, a homogeneous, annular outside lining of the shroud bond is achieved, and, on the other hand, a detuning of the natural frequencies of adjacent blade arrangements 120, 220.

Figure 2:
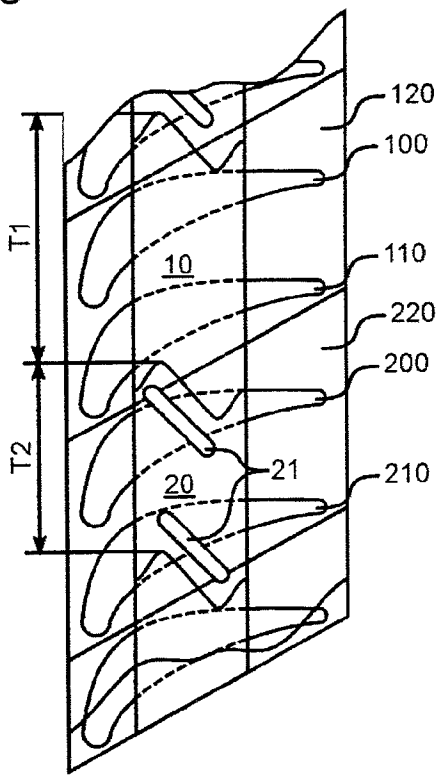
FIG. 2 shows an execution of a portion of a blade row according to a further embodiment of the present invention.

In a depiction corresponding to FIG. 1, FIG. 2 shows an execution of a portion of a rotor assembly of a turbine according to another embodiment of the present invention. Elements corresponding to the embodiment according to FIG. 1 described in the foregoing are designated by identical reference numbers so that only the differences from this embodiment will be discussed in the following.

In the embodiment according to FIG. 2, each blade arrangement 120, 220 has two rotor blades 100, 110 and 200, 210, respectively, which are configured integrally with a common platform and are connected to a common shroud 10 or additional shroud 20. In this case as well, the shrouds 10, 20 have different extensions T1, T2 in the circumferential direction.

The shrouds 20 also have recesses or pockets 21, which further change the weight and moment of inertia of the blade arrangements 220 and thus detune their natural frequencies, while the blade arrangements 120 do not have such recesses.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMBERS

10 First shroud
20 Second (additional) shroud
21 Recess (pocket)
100, 110 First rotor blades
200, 210 Second (additional) rotor blades
120 First blade arrangement (platform)
220 Second (additional) blade arrangement (platform)

What is claimed is:

1. A blade row for a turbomachine, comprising:

a plurality of first blade arrangements each having a first shroud and a first number of blades, wherein the first shroud is attached to a respective tip of the first number of blades, and wherein the first shroud has a first extension in a circumferential direction; and a plurality of second blade arrangements each having a second shroud and a second number of blades, wherein the second shroud is attached to a respective tip of the second number of blades, and wherein the second shroud has a second extension in the circumferential direction;

wherein adjacent first and second shrouds in the blade row have complementary, undulated contact surfaces facing each other in the circumferential direction, wherein the first number of blades is equal to the second number of blades, and wherein the first extension is longer than the second extension; and wherein an overhang of the blades in the first blade arrangements in an axial direction relative to the first shroud is the same as the overhang of the blades in the second blade arrangements in the axial direction relative to the second shroud.

2. The blade row according to claim 1, wherein the first blade arrangements of the plurality of first blade arrangements are distributed cyclically with respect to the second blade arrangements of the plurality of second blade arrangements over a circumference of the blade row.

3. The blade row according to claim 1, wherein the second shroud has a recess.

4. The blade row according to claim 3, wherein the first shroud does not have a recess.

5. A turbomachine, comprising at least one rotor and/or guide vane assembly according to the blade row of claim 1.

6. The turbomachine according to claim 5, wherein the turbomachine is a gas turbine.

7. The blade row according to claim 1, wherein the first number of blades and the second number of blades is 1.

8. The blade row according to claim 1, wherein the first number of blades and the second number of blades is 2.

9. A blade row for a turbomachine, comprising:

a first blade arrangement having a first number of blades and a first shroud, wherein the first shroud is attached to a respective tip of the first number of blades, and wherein the first shroud has a first extension in a circumferential direction; and a second blade arrangement having a second number of blades and a second shroud, wherein the second shroud is attached to a respective tip of the second number of blades, and wherein the second shroud has a second extension in the circumferential direction;

wherein adjacent first and second shrouds in the blade row have complementary, undulated contact surfaces facing each other in the circumferential direction, wherein the first number of blades is equal to the second number of blades, and wherein the first extension is longer than the second extension; and wherein an overhang of the blades in the first blade arrangement in an axial direction relative to the first shroud is the same as the overhang of the blades in the second blade arrangement in the axial direction relative to the second shroud.

10. The blade row according to claim 9, wherein the first shroud and the second shroud have a same dimension in a radial direction and an axial direction.

11. The blade row according to claim 9, wherein the first number of blades and the second number of blades is 1.

12. The blade row according to claim 9, wherein the first number of blades and the second number of blades is 2.

* * * * *